US007431442B2

(12) United States Patent
Rosa

(10) Patent No.: US 7,431,442 B2
(45) Date of Patent: Oct. 7, 2008

(54) SEALING FOR INKJET ORIFICES

(75) Inventor: Dell T. Rosa, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 390 days.

(21) Appl. No.: 11/127,885

(22) Filed: May 12, 2005

(65) Prior Publication Data

US 2006/0268060 A1 Nov. 30, 2006

(51) Int. Cl.
*B41J 2/175* (2006.01)

(52) U.S. Cl. ..... 347/87

(58) Field of Classification Search ..... 347/22, 347/28, 29, 44, 87; 206/813; 428/346, 347
See application file for complete search history.

(56) References Cited

U.S. PATENT DOCUMENTS 3,769,136 A 10/1973 Ospelt
4,896,788 A * 1/1990 Bolte et al. ..... 220/359.2
4,977,003 A * 12/1990 Brown et al. ..... 428/35.5
5,110,643 A * 5/1992 Akao et al. ..... 428/35.9
5,254,302 A * 10/1993 Yamanaka ..... 264/129
5,400,060 A 3/1995 Carlotta
5,589,246 A * 12/1996 Calhoun et al. ..... 428/120
5,917,514 A 6/1999 Higuma et al.
6,429,242 B1 8/2002 Macher et al.
6,547,366 B2 * 4/2003 Sharma et al. ..... 347/22
6,588,875 B1 * 7/2003 Kleinhammer ..... 347/29
6,634,732 B2 10/2003 Farr et al.

FOREIGN PATENT DOCUMENTS

DE 003909825 * 9/1990

* cited by examiner

*Primary Examiner*—Anh T. N. Vo
(74) *Attorney, Agent, or Firm*—Dinsmore & Shohl, LLP

(57) ABSTRACT

An inkjet ink cartridge (20) having nozzle holes (24) to eject ink is sealed against escape of the ink from the orifices by tape (1) is hard at any temperature the container might reach during shipment and handling. This hardness resists any creep of the tape material into the orifices. The tape is applied after the surface that contacts the region of the orifices is softened by application of solvent for the material of the tape. The solvent softens the surface, causing it to conform closely to the surface having the nozzle plates in the manner of conventional pressure sensitive adhesive. The solvent is then removed. The tape can have high temperature resistance and the solvent need not be one that acts on the nozzles.

16 Claims, 2 Drawing Sheets

SEALING FOR INKJET ORIFICES

TECHNICAL FIELD

This invention relates to inkjet printing and particularly to an effective seal over the orifices of inkjet printing cartridges.

BACKGROUND OF THE INVENTION

Inkjet cartridges are typically sealed with adhesive tape over the ink orifices to prevent ink evaporation, ink leakage, and contamination from getting into the nozzle holes. The adhesive of the adhesive tape tends to swell and soften when in contact with ink. The swollen softer adhesive can and does flow into the nozzle holes of the ink cartridge and occludes them, thereby preventing ejection of ink from the print head. This represents a challenge to engineer an adequate solution for both sealing the nozzle holes and not occluding them. All pressure sensitive adhesive based adhesive systems are reasonably expected to suffer from this same defect.

Most manufacturers have addressed this problem primarily through two approaches. First is to use a thermoplastic adhesive that has adherent properties when hot, and plastic properties when cool. The thermoplastic is heated just long enough to adhere the film to the nozzle plate and seal the nozzle holes, the thermoplastic promptly cools, freezing the material in place. In this form thermoplastic adhesives are significantly less susceptible to swelling, softening and flowing upon contact with ink. The second method involves a mechanical seal. A mechanical seal is usually composed of an elastomeric component that can be physically squeezed against the nozzle plate surface to seal the nozzle holes. Several variations of these are known in the art.

Other known options are to use a separate cap of some kind instead of a tape or the like directly over the orifices. Such options are prone to ink leakage because of poor sealing, with consequent ink migration over the printhead. This is unacceptable to the customer.

With ongoing progress in inkjet printing, the nozzle holes are smaller. Smaller holes are more subject to being clogged. Direct application of tape on the nozzles entails some entry of tape material into the nozzle orifices, such as by initial pressure or by creep over time because of heat or chemical action of the ink. In the small orifices especially, the entered material is prone to breaking off and clogging the orifice.

Conventional pressure sensitive adhesive now used to seal nozzle holes is mobile and has a melting point significantly less than 400 degrees C. The mobility of pressure sensitive adhesive is necessary for the adhesive to closely conform to the surface to which it is applied and thereby adhere to it. Heat may be applied along with pressure when nozzles are sealed with pressure sensitive adhesive. But temperatures are limited as ink near the nozzles can expand and be expelled by high heat. Ink on the nozzle plate tends to destroy the sealing action of pressure sensitive adhesive.

This invention combines the simplicity of sealing with an applied tape or the like with the advantages or a resulting seal element being one melting at temperature only above 400 degrees C. The high melting seal element that will not subsequently creep into nozzle holes during environmental stress or when at high temperature which sometimes occur during handling, storage, and use of an inkjet cartridge or other container.

DISCLOSURE OF THE INVENTION

An inkjet ink cartridge or other container having nozzle holes or like orifices to eject ink is sealed against escape of the ink from the orifices by tape or like film that is hard at any temperature the container might reach during shipment and handling. This hardness resists any creep of the tape material into the orifices.

The tape is applied by simple application of pressure and, preferably, heat after the surface which contacts the region of the orifices is softened by application of solvent for the material of the tape. The solvent softens the surface, causing it to conform closely to the surface having the nozzle plates in the manner of conventional pressure sensitive adhesive.

After the tape is so applied, loss of the solvent results in a hard element covering the orifices which will not creep into the orifices during subsequent environmental stress. The tape or other element preferably melts only at above 400 degrees C., which is higher than any expected heat stress. That also permits an optional application of significant heat to cause the solvent to leave the element.

Although a film, such as in the form of a standard adhesive tape having opposed, generally flat sides is a preferred embodiment of the seal element, Any element having a smooth surface to contact the orifices is an alternative.

It is significant that embodiments of this invention need not rely on the solvent acting on the part of the container surrounding and defining the orifices. This might damage the orifices for inkjet printing and might cause a bond that is too strong, as the tape or other element is to be removed by a user before placing the container in a printer for use. Instead, merely softening the surface of the element is sufficient.

BRIEF DESCRIPTION OF THE DRAWINGS

The details of this invention will be described in connection with the accompanying drawings, in which.

DESCRIPTION OF PREFERRED EMBODIMENTS

Wide ranges of polymeric materials are at least partially soluble in solvents that are not incompatible with inks for inkjet print. Handbooks for adhesive and sealants lists materials and their solvent, and such standard information many be employed to select a sealing material and its solvent in accordance with this invention.

Solvent welding is well established. Perhaps the most commonly solvent welded plastic is polyvinyl chloride (PVC). This is the method of choice for joining PVC piping, and it is accomplished at room temperature. This invention, however, seeks a limited bond in a particular environment.

Figure 1:
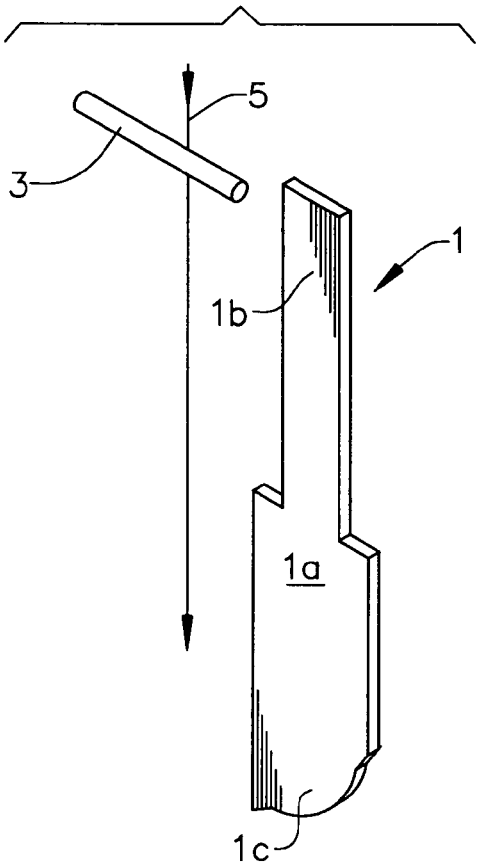
FIG. 1 is a perspective view illustrating a single material sealing tape of this invention and the application of solvent to one side of the tape.

With reference to FIG. 1 a single material seal tape 1 is shown having a wide part 1*a*, a narrow part 1*b*, and a tab 1*c* part for manual grasping. In this illustrative embodiment the material of seal 1 is K-RESIN styrene-butadiene copolymer, (Product of PCChem) of thickness of 1 mil.

One side of tape 1 is treated with toluene, a solvent for the copolymer, except that the tab 1*c* is not treated as that is to stay loose for grasping. FIG. 1 illustrates the solvent treatment with a roller 3 suggestive of a liquid applicator and the arrow 5 suggestive of the applicator acting on parts 1*a* and 1*b* of tape 1. One embodiment is to apply the toluene with a sponge stick and then apply the tape 1 to the cartridge as will be described within 30 seconds. (This time period can be readily judged based on the volatility of the solvent after being applied.)

Figure 2:
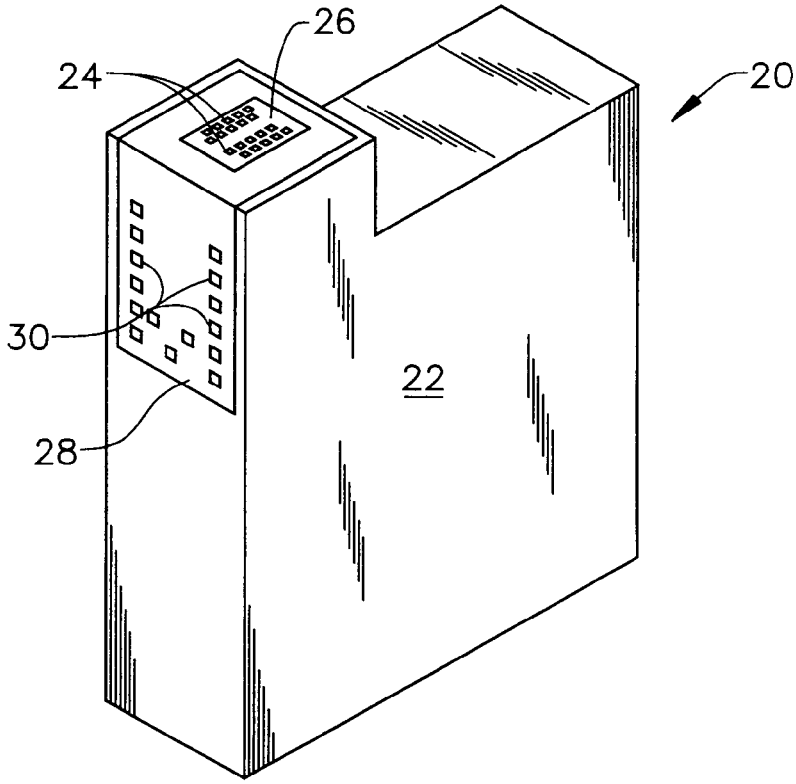
FIG. 2 is a perspective view of an illustrative inkjet ink cartridge to be sealed by this invention.

FIG. 2 is illustrative of a cartridge 20 that is to be sealed by tape 1. The main body 22 of the cartridge 20 contains the ink to be expelled through nozzle holes 24 that are in a member termed a nozzle plate 26. A common material for the nozzle plate and the material of this illustrative embodiment is polyimide. Toluene is not a solvent for polyimide.

A thin, flexible electrical circuit member 28 is attached to cartridge 20 having exposed electrical contact pads 30. As is conventional, the tape 1 of this embodiment also converts contact pads 30 to protect them during shipment and handling of cartridge 20. Since they are relatively sturdy, metal elements, virtually any tape that covers them will adequately protect them, while sealing the nozzle holes 24 raises the technical problems discussed in the foregoing.

Finally, it is noted that nothing in the cartridge of FIG. 2 is novel with respect to this invention, and the invention may be practiced without modifying the cartridge being sealed, although in specific circumstances, a tape may be designed so as not to contact some element sensitive to the solvent, or such an element may be protectively coated.

Figure 3:
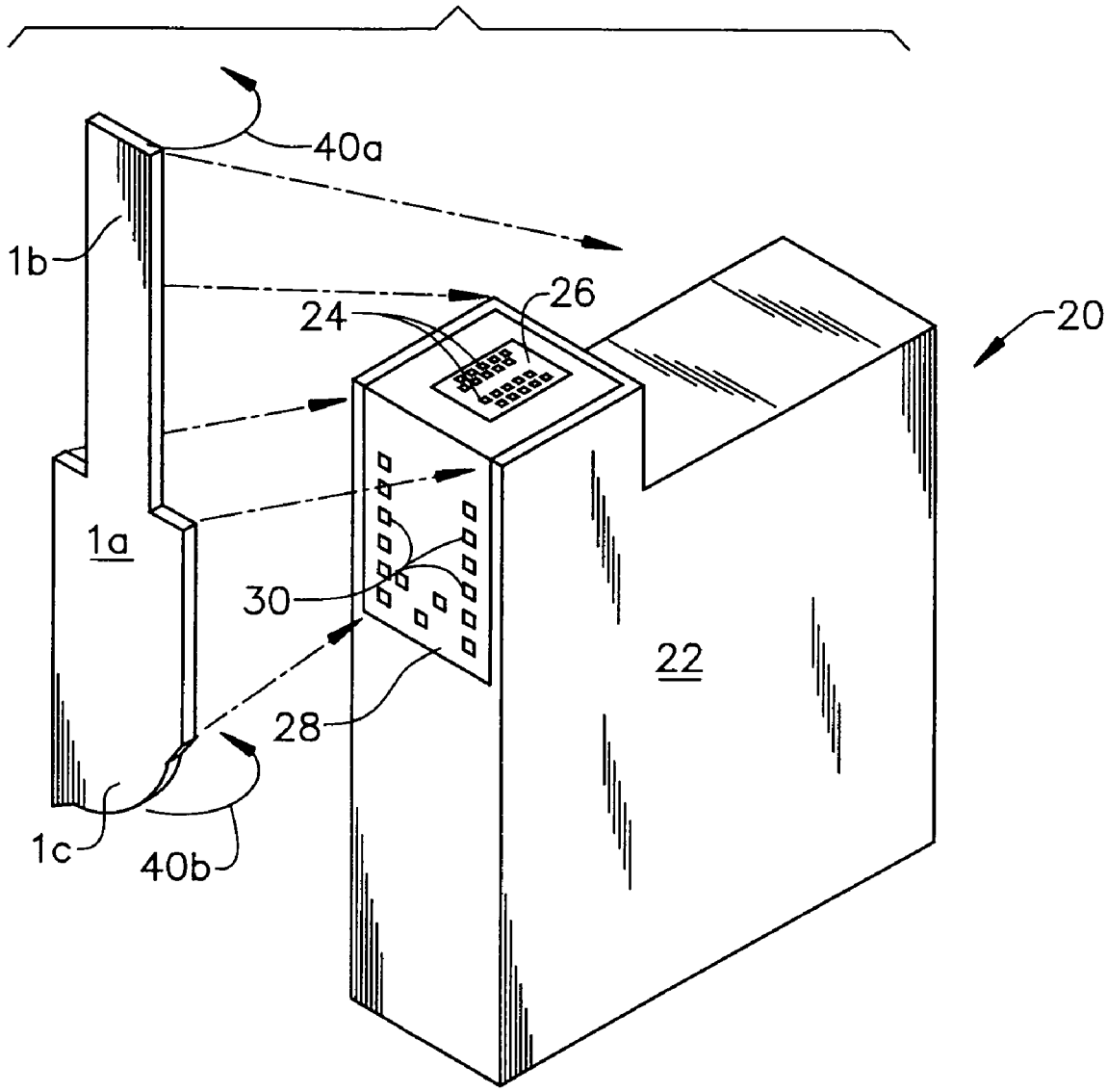
FIG. 3 illustrated the application of the tape to the cartridge to seal the nozzle holes of the cartridge.

FIG. 3 illustrates the application to tape 1 to the cartridge 20. Arrows 40*a* and 40*b* indicate the rotation of tape 1 so that the solvent treated side contacts the cartridge. The dashed arrows are suggestive of the tape 1 being brought into contact with the cartridge 20. Part 1*a* contacts and covers pads 30. Part 1*b* fits over nozzles 24 and bends over to also contact the part of cartridge that is perpendicular to the plane of nozzle plate 24.

Tape 1 is applied with sufficient pressure over the surfaces 1*a* and 1*b* to deform slightly the solvent treated surface, which is a moderate pressure in this illustrative embodiment. Heat may be used during the application of pressure.

After such application of tape 1 the solvent must be permitted or caused to leave the tape 1. This can be accelerated by heat so as to increase evaporation of the solvent. As the tape 1 normally will have a higher melting point than pressure sensitive tape, the heat can be corresponding higher, both during application and during removal of the solvent.

The styrene-butadiene copolymer of the embodiment has a glass transition temperature of 96.27 C., which is well above the temperature that the printhead should experience. This high glass transition temperature should reduce flow of the material into the nozzle holes.

Tape 1 is a single film. Multilayer films are not excluded by this invention. Layers may be added, for example, for strength, as a moisture barrier, as an air barrier, for electrostatic dissipation, for electrostatic shielding and a printable surface. Similarly, after application the film may be further treated by, for example, radiation for hardening.

What is claimed is:

1. A method of sealing orifices of an inkjet ink container comprising the acts of applying a solvent for a material to a smooth surface of an element made of said material to soften said surface, said surface being of area to cover said orifices, applying said element to said orifices with said surface contacting the region of said orifices and covering said orifices, and permitting or causing said solvent to leave said material so as to harden said material, wherein said orifices are sealed by said element.

2. The method of claim 1 in which said solvent is applied one hour or less before applying said element to said orifices.

3. The method of claim 1 in which said element has a melting point above 400 degrees C.

4. The method of claim 1 in which said solvent is caused to leave said element by applying heat to said element after said applying said element to said orifices.

5. The method of 4 in which said element has a melting point above 400 degrees C.

6. A method of sealing orifices of an inkjet ink container comprising the acts of applying a solvent for a material to one surface of a film made of said material having opposed, generally flat surfaces to soften said one surface, said one surface being of area to cover said orifices, applying said film to said orifices with said one surface contacting the region of said orifices and covering said orifices, and permitting or causing said solvent to leave said material so as to harden said material, wherein said orifices are sealed by said film.

7. The method of claim 6 in which said solvent is applied one hour or less before said applying said film to said orifices.

8. The method as in claim 6 in which said film has a melting point above 400 degrees C.

9. The method as in claim 6 in which said container in the region having said orifices is substantially inert to the solvent action of said solvent.

10. The method of claim 6 in which said solvent is caused to leave said film by applying heat to said film after said applying said film to said orifices.

11. The method of claim 10 in which said film has a melting point above 400 degrees C.

12. A method of sealing orifices of an inkjet ink container comprising the acts of applying a solvent for a material to a smooth surface of an element made of said material to soften said surface, said surface being an area to cover said orifices, applying said element to said orifices with said surface contacting the region of said orifices and covering said orifices, said container in the region of said orifices being substantially inert to the solvent action of said solvent, and permitting or causing said solvent to leave said material so as to harden said material, wherein said orifices are sealed by said element.

13. The method of claim 12 in which said solvent is applied one hour or less before applying said element to said orifices.

14. The method of claim 12 in which said element has a melting point above 400 degrees C.

15. The method of claim 12 in which said solvent is caused to leave said element by applying heat to said element after applying said element to said orifices.

16. The method of claim 15 in which said element has a melting point above 400 degrees C.

* * * * *